US009322178B2

(12) United States Patent
Kastner et al.

(10) Patent No.: US 9,322,178 B2
(45) Date of Patent: Apr. 26, 2016

(54) SKYLIGHT WITH SUNLIGHT PIVOT

(71) Applicant: VKR HOLDING A/S, Hørsholm (DK)

(72) Inventors: Steve Roy Kastner, Greenwood, SC (US); Charles Joseph Rimsky, Greenwood, SC (US)

(73) Assignee: VKR HOLDINGS A/S, Horsholm (DK)

( * ) Notice: Subject to any disclaimer, the term of this patent is extended or adjusted under 35 U.S.C. 154(b) by 0 days.

(21) Appl. No.: 14/570,582

(22) Filed: Dec. 15, 2014

(65) Prior Publication Data

US 2015/0167305 A1 Jun. 18, 2015

Related U.S. Application Data

(60) Provisional application No. 61/916,247, filed on Dec. 15, 2013.

(51) Int. Cl.

| | |
|---|---|
| ***E04B 7/18*** | (2006.01) |
| ***E04D 13/03*** | (2006.01) |
| *F21S 11/00* | (2006.01) |

(52) U.S. Cl.

CPC ..... *E04D 13/033* (2013.01); *E04B 7/18* (2013.01); *E04D 2013/034* (2013.01); *F21S 11/002* (2013.01)

(58) Field of Classification Search

CPC ... E04D 13/03; E04D 13/0305; E04D 13/031; E04D 13/032; E04D 13/0325; E04D 13/033; E04D 13/035; E04D 13/0351; E04D 13/0352; E04D 13/0355; E04D 13/0357; E04D 13/0358; E04D 13/034; E04D 13/0345; E04D 2013/034; E04B 7/18; F21S 11/002

USPC ..... 52/200, 173.3, 171.1; 359/591, 599, 359/592, 595; 362/557

See application file for complete search history.

(56) References Cited

U.S. PATENT DOCUMENTS

| | | | |
|---|---|---|---|
| 1,254,520 | A | 1/1918 | MacDuff |
| 1,504,970 | A | 8/1924 | Pascucci |
| 2,858,734 | A | 11/1958 | Boyd |
| 2,993,409 | A | 7/1961 | Boyd |
| 4,069,812 | A | 1/1978 | O'Neill |
| 4,306,769 | A | 12/1981 | Martinet |
| 4,339,900 | A | 7/1982 | Freeman |
| 4,519,675 | A | 5/1985 | Bar-Yonah |
| 4,839,781 | A | 6/1989 | Barnes et al. |

(Continued)

FOREIGN PATENT DOCUMENTS

| | | |
|---|---|---|
| GB | 2384022 C | 5/2005 |
| JP | 19855149005 | 10/1985 |
| JP | 19855149005 U | 10/1985 |

*Primary Examiner* — Mark Wendell

(74) *Attorney, Agent, or Firm* — Timothy D. St. Clair; Nexsen Pruet, LLC

(57) ABSTRACT

A skylight with a sunlight pivot is provided. The skylight includes an external cover, a light channel, and a sunlight pivot disposed between the cover and the light channel. The sunlight pivot may include a periphery, a plurality of struts, and first and second prisms connected to at least two of these struts. The first and second prisms may define a void between them. The first prism has a cross-section configured to redirect light incident upon the exterior of the pivot to increase the amount of light passing into the light channel. The second prism is configured with a cross-section configured to redirect light incident upon the exterior of the pivot to decrease the amount of light passing through the periphery.

20 Claims, 8 Drawing Sheets

(56) References Cited

U.S. PATENT DOCUMENTS

| | | | |
|---|---|---|---|
| 5,054,885 | A | 10/1991 | Melby |
| 5,099,622 | A | 3/1992 | Sutton |
| 5,404,869 | A | 4/1995 | Parkyn, Jr. et al. |
| 5,408,795 | A | 4/1995 | Eljadi et al. |
| 5,416,684 | A | 5/1995 | Pearce |
| 5,444,606 | A | 8/1995 | Barnes et al. |
| 5,467,564 | A | 11/1995 | DeKeyser et al. |
| 5,493,824 | A | 2/1996 | Webster et al. |
| 5,502,935 | A | 4/1996 | Demmer |
| 5,551,042 | A | 8/1996 | Lea et al. |
| 5,648,873 | A | 7/1997 | Jaster et al. |
| 5,655,339 | A | 8/1997 | DeBlock et al. |
| 5,878,539 | A | 3/1999 | Grubb |
| 5,896,712 | A | 4/1999 | Chao |
| 5,896,713 | A | 4/1999 | Chao et al. |
| 5,983,581 | A | 11/1999 | DeBlock et al. |
| 6,035,593 | A | 3/2000 | Chao et al. |
| 6,219,977 | B1 | 4/2001 | Chao et al. |
| 6,256,947 | B1 | 7/2001 | Grubb |
| 6,356,391 | B1 | 3/2002 | Gardiner et al. |
| 6,407,859 | B1 | 6/2002 | Hennen et al. |
| 6,456,437 | B1 | 9/2002 | Lea et al. |
| 6,560,026 | B2 | 5/2003 | Gardiner et al. |
| RE38,217 | E | 8/2003 | DeBlock et al. |
| 6,707,611 | B2 | 3/2004 | Gardiner et al. |
| 6,710,941 | B2 | 3/2004 | Hennen et al. |
| 6,724,535 | B1 | 4/2004 | Clabburn |
| 7,152,384 | B1 | 12/2006 | McCarty |
| 7,159,364 | B2 | 1/2007 | Rillie |
| 7,185,464 | B2 | 3/2007 | Bracale |
| 7,251,084 | B2 | 7/2007 | Shimura |
| 7,322,156 | B1 | 1/2008 | Rillie et al. |
| 7,384,173 | B2 | 6/2008 | Whitney |
| 7,395,636 | B2 | 7/2008 | Blomberg |
| 7,410,284 | B2 | 8/2008 | Edmonds |
| 7,546,709 | B2 * | 6/2009 | Jaster ..... E04D 13/03 359/591 |
| 7,593,615 | B2 | 9/2009 | Chakmakjian et al. |
| 7,639,423 | B2 | 12/2009 | Kinney et al. |
| 7,701,648 | B2 | 4/2010 | Amano et al. |
| 7,710,663 | B2 | 5/2010 | Barnes et al. |
| 7,736,014 | B2 | 6/2010 | Blomberg |
| 7,757,444 | B1 | 7/2010 | Halliday |
| 7,763,331 | B2 | 7/2010 | Jones et al. |
| 7,859,759 | B2 | 12/2010 | Coyle et al. |
| 7,900,405 | B1 | 3/2011 | Jacoby |
| 7,950,838 | B2 | 5/2011 | Johnson et al. |
| 7,957,082 | B2 | 6/2011 | Mi et al. |
| 7,965,447 | B2 | 6/2011 | Olczak |
| 7,982,956 | B2 | 7/2011 | Kinney et al. |
| 8,082,705 | B2 | 12/2011 | Jaster et al. |
| 8,083,363 | B2 | 12/2011 | Jaster |
| 8,098,433 | B2 | 1/2012 | Rillie et al. |
| 8,098,434 | B1 | 1/2012 | Hoffend, Jr. et al. |
| 8,111,968 | B2 | 2/2012 | Chakmakjian et al. |
| 8,132,375 | B2 | 3/2012 | Jaster |
| 8,165,435 | B2 | 4/2012 | Martin-Lopez |
| 8,168,271 | B2 | 5/2012 | Jones et al. |
| 8,193,480 | B2 | 6/2012 | Tanis-Likkel et al. |
| 8,369,678 | B2 | 2/2013 | Chakmakjian et al. |
| 8,797,652 | B2 * | 8/2014 | Mosher ..... G02B 26/0808 359/619 |
| 2003/0079422 | A1 * | 5/2003 | Bracale ..... E04D 13/033 52/200 |
| 2004/0100698 | A1 * | 5/2004 | Aoki ..... E04D 13/033 359/591 |
| 2004/0246605 | A1 | 12/2004 | Stiles et al. |
| 2005/0078483 | A1 * | 4/2005 | Bernard ..... F21V 7/0058 362/327 |
| 2007/0070531 | A1 * | 3/2007 | Lu ..... F24J 2/085 359/851 |
| 2010/0224232 | A1 | 9/2010 | Cummings et al. |

* cited by examiner

SKYLIGHT WITH SUNLIGHT PIVOT

CROSS-REFERENCE TO RELATED APPLICATION

This application claims the priority benefit of Provisional U.S. Patent Application Ser. No. 61/916,247 filed on Dec. 15, 2013, the entire scope and content of which are hereby incorporated herein by reference.

TECHNICAL FIELD

The present invention relates generally to a skylight with a sunlight pivot and, more particularly, to a skylight with a light transmitting body having first and second refracting prisms, the first and second prisms defining a void therebetween.

BACKGROUND

Skylights provide effective internal lighting for buildings, maximizing visual comfort and reducing energy usage from artificial lighting.

A skylight may include a rooftop element through which sunlight enters the skylight structure, the sunlight being transmitted through the skylight structure to the interior of the building. For example, a building skylight may also include a channel through roof trusses, the channel being disposed between the rooftop element and the interior opening of the skylight. Alternatively, a tubular skylight may include a rooftop element and a light conducting channel that is a tube, depending downwardly from the rooftop element and terminating at a room interior.

Sunlight received by the rooftop element varies in direction and incident angle during a single day. In early morning and late afternoon hours, the incident angle at which sunlight strikes the rooftop element of a skylight is relatively low. Furthermore, at sunrise and sunset, sunlight is attenuated due to its relatively longer passage through the Earth's atmosphere. Conversely, at mid-day, sunlight's incident angle upon a skylight rooftop element is relatively high. During the course of a day, the sun's path through the sky relative to a skylight rooftop element is arcuate relative to the horizon. Furthermore, at mid-day, the sunlight incident angle upon a skylight rooftop element at the Winter solstice is low, while the sunlight incident angle at the Summer solstice is high, with the incident angle varying throughout the year between those two extremes.

It has been found that the irradiance from sunlight arriving at a skylight from a low incident angle may be further reduced before reaching the interior of a building structure, as the sunlight at a low incident angle tends to be reflected several times within the skylight structure, and thereby lessened, before reaching the interior of the building. Furthermore, it has been found that the irradiance received within a building interior from sunlight arriving at a skylight from a high incident angle may be undesirably strong, causing for example "hot spots" within the building interior, inasmuch as such sunlight arrives at the building interior through the skylight structure with fewer reflections within the skylight structure, and thereby with greater retained brilliance.

In view of the foregoing, it would be advantageous to control the illuminance within a building received from a skylight throughout the day, and during the change of seasons, as the incident angle of sunlight changes.

SUMMARY OF THE INVENTION

A skylight entrance sunlight pivot is provided. As revealed in the following description and the figures herein, this invention discovers an effective technology that advantageously controls the sunlight entering a skylight as the sunlight incident angle changes.

In accordance with certain aspects of certain embodiments of the present technology, a skylight is provided that includes an external cover as an exterior rooftop element, a light channel depending downwardly beneath the external cover, and a sunlight pivot. The sunlight pivot may be disposed beneath the external cover and above the light channel, within the cover, and may include a periphery, a plurality of struts, and first and second prisms. The plurality of struts may extend upwardly and inwardly from about the periphery. The first and second prisms may define a first void between them and may be carried by at least two of the plurality of struts. The first prism may define a first cross-section and the second prism may define a second cross-section, the first cross-section being different from the second cross-section.

In accordance with additional aspects of other embodiments of the present technology, the first prism may extend in a first arc. In certain instances, the second prism may extend in a second arc, the second arc being shorter than the first arc.

In accordance with further aspects of other embodiments of the present technology, the first prism may terminate at an aperture that is devoid of refraction.

With still further aspects of other embodiments of the present technology, the first prism may be parallel to the periphery.

Additionally, in particular embodiments, the periphery may be curvilinear. In certain configurations, a third prism may be included, the third prism residing adjacent to the first prism and defining a second void therebetween. Individual forms may include a fourth prism, the fourth prism residing adjacent to the second prism and defining a third void therebetween. In selective illustrations, the first and third prisms may reside in a single first conical frustum. In other or additional instances, the second and fourth prisms reside in a single second conical frustum. In particular embodiments, the first conical frustum may be nonparallel to the second conical frustum.

In accordance with certain aspects of other embodiments of the present technology, a skylight is provided with an external cover, a light channel below the external cover, and a sunlight pivot. The sunlight pivot may be disposed between the external cover and the light channel, and may include a periphery, a plurality of struts, and first and second prisms. The plurality of struts may extend upwardly and inwardly from proximate to the periphery. The first and second prisms may define a void between them and may be connected to at least two of the plurality of struts. The first prism may define a first cross-section configured to redirect light incident upon the exterior of the pivot to increase the amount of light passing through the periphery, and the second prism may a second cross-section configured to redirect light incident upon the exterior of the pivot to decrease the amount of light passing through the periphery.

In accordance with additional aspects, the first prism may be parallel to the periphery. Additionally, or alternatively, the first and second prisms may be parallel.

In accordance with still further aspects of other embodiments of the present technology, the first and second prisms may be curvilinear.

In accordance with other aspects of other embodiments of the present technology, the first cross-section and/or the second cross-section may be constant along their respective lengths.

In particular illustrations, the first and/or second prisms may each have triangular cross-sections, the hypotenuses of the respective cross-sections facing outwardly from the pivot.

In accordance with certain aspects of other embodiments of the present technology, a skylight is provided with an external cover, a light channel residing below the external cover, and sunlight pivot. The sunlight pivot may be disposed between the external cover and the light channel. Still further, the sunlight pivot may include: a periphery and an apex, the periphery residing below the apex; a plurality of struts, each of the plurality of struts extending proximate from the apex toward the periphery; and a plurality of first prisms and a plurality of second prisms. Each of the first prisms may have a same first cross-section, configured to refract light incident upon the exterior of the pivot to increase the amount of light passing into the skylight and may define a void between any two of each such first prisms. Each of the plurality of second prisms may have a same second cross-section, configured to refract light incident upon the exterior of the pivot to decrease the amount of light passing into the skylight and define a void between any two of each such second prisms. The plurality of first prisms and the plurality of second prisms may be carried by at least two of the plurality of struts.

In accordance with additional aspects of other embodiments of the present technology, the plurality of first prisms may reside in a first conical frustum and the plurality of second prisms may reside in a second conical frustum, the first and second conical frustums being nonproportional.

In accordance with yet additional aspects of other embodiments of the present technology, the first prisms may be parallel to the second prisms.

BRIEF DESCRIPTION OF THE DRAWINGS

The details of the present technology, both as to its structure and functionality, can be better understood with reference to the accompanying figures. It should be noted that these figures are not necessarily to scale in all instances.

DETAILED DESCRIPTION

Figure 1:
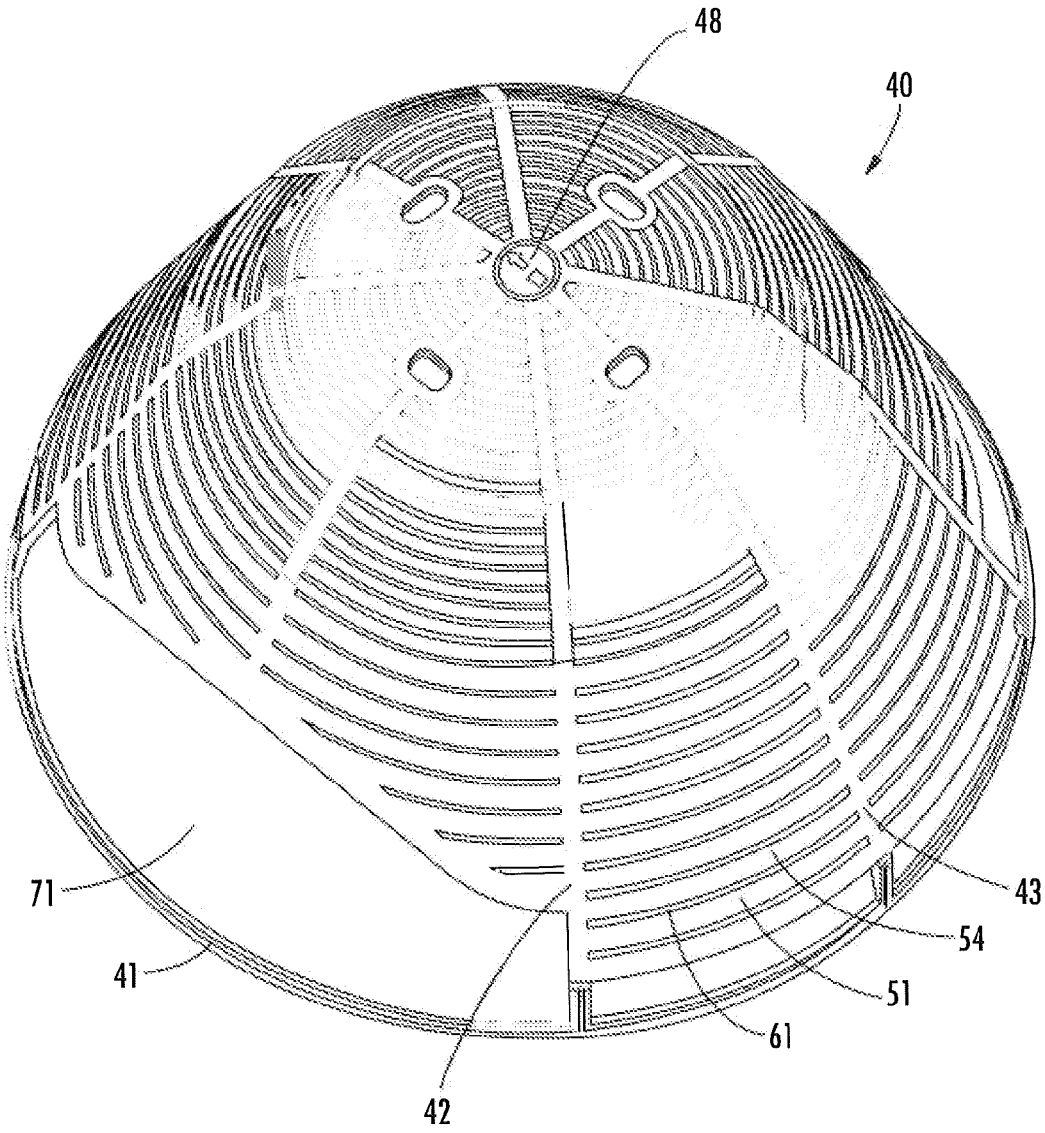
FIG. 1 is a perspective view of a skylight sunlight pivot in accordance with certain aspects of the present invention, from an upper, West position.

Reference will now be made in detail to the presently preferred embodiments of the invention, one or more examples of which are illustrated in the drawings. Each example is provided by way of explanation of the invention and not meant as a limitation of the invention. For example, features illustrated or described as part of one embodiment can be used in another embodiment to yield a yet still further embodiment. It is intended that the present application include such modifications and variations as come within the scope and spirit of the invention. The embodiments described below are not exhaustive nor do they limit the invention to the precise forms disclosed. Rather, the described embodiments are chosen so that others skilled in the art to which this invention pertains may appreciate and understand the principles and practices of the present invention A skylight is provided. The skylight 10 may include a cover 20, a light channel 30, and a sunlight pivot 40. Cover 20 may provide an exterior rooftop element for skylight 10. Pivot 40 is configured to be disposed between the cover 20 and the light channel 30, and enclosed within the cover 20. Pivot 40 is light-transmissive, being fabricated of material translucent or transparent, or selectively both.

The pivot 40 may have an equatorial side 44, an opposite polar side 45, and an East side 46 and an opposing West side 47. The East side 46 may include a first aperture 71, and the West side 47 may include a second aperture 72. The first aperture 71 and/or the second aperture 72 may be devoid of refraction, such that sunlight incident upon first aperture 71 and/or the second aperture 72 enters the light channel 30 from the pivot 40 at the same incident angle as it entered the first aperture 71 and/or the second aperture 72.

The pivot 40 may include a periphery 41. Extending upwardly and inwardly from the periphery 41 may be a plurality of struts, for example a first strut 42 and a second strut 43. In certain embodiments, the first strut 42 and the second strut 43 may extend from an apex 48 of the pivot 40 toward the periphery 41.

The first strut 42 and the second strut 43 may carry a plurality of prisms, for example a first prism 51 and a second prism 54. The first prism 51 and the second prism 54 may define between them a first void 61. Further, the first prism 51 may define a first cross-section 52, and the second prism 54 may define a second cross-section 55, the first cross-section 52 and the second cross-section 55 being of different geometry from one another. In certain configurations, and from particular perspectives, the first prism 51 may extend in a first arc 53. Similarly, the second prism 54 may extend in a second arc 56. In some embodiments, the first arc 53 may be longer than the second arc 56.

In certain applications, the first prism 51 may terminate at a first aperture 71.

A particular configuration may include a third prism 57 and a fourth prism 58. The third prism 57 may reside adjacent to the first prism 51, and the fourth prism 58 may reside adjacent to the second prism 54, with a second void 62 defined between the first prism 51 and the third prism 57, and a third void 63 defined between the second prism 54 and the fourth prism 58. In particular embodiments, the first prism 51 and the third prism 57 may reside in a first conical frustum 81. Similarly, the second prism 54 and the fourth prism 58 may reside in a single second conical frustum 82. If advantageous, the exterior shape of pivot 40 in some instances may be complementary to the shape of the interior surface of cover 20.

Other features for certain embodiments include the following attributes. In one, the first prism 51 may be parallel to the periphery 41. Optionally, the periphery 41 may be curvilinear. Still further, in certain applications the first prism 51 and the second prism 54 may be parallel to one another. Further still, the first prism 51 and the second prism 54 may be curvilinear when viewed from certain perspectives. Moreover, in some applications, the first cross-section 52 may be constant along the length of the first prism 51 in some applications, whereas in other applications it may very along the length of the first prism 51.

In particular constructions, the first prism 51 and the second prism 54, as well as, optionally, the third prism 57 and the fourth prism 58, may each be triangular in cross-section. To achieve certain performances in such constructions, the hypotenuses of some or all of these respective cross-sections may face outwardly away from the pivot 40.

Considering the foregoing, the first prism 51 may have a first cross-section 52 configured to refract light incident upon the exterior of the pivot 40 so as to increase the amount of light passing into the light channel 30 than would occur in the absence of the first prism 51. Similarly, the second prism 54 may be configured in cross-section to refract light incident upon the exterior of the pivot 40 so as to decrease the amount of light that would otherwise pass into the light channel 30 in the absence of the second prism 54.

Figure 2:
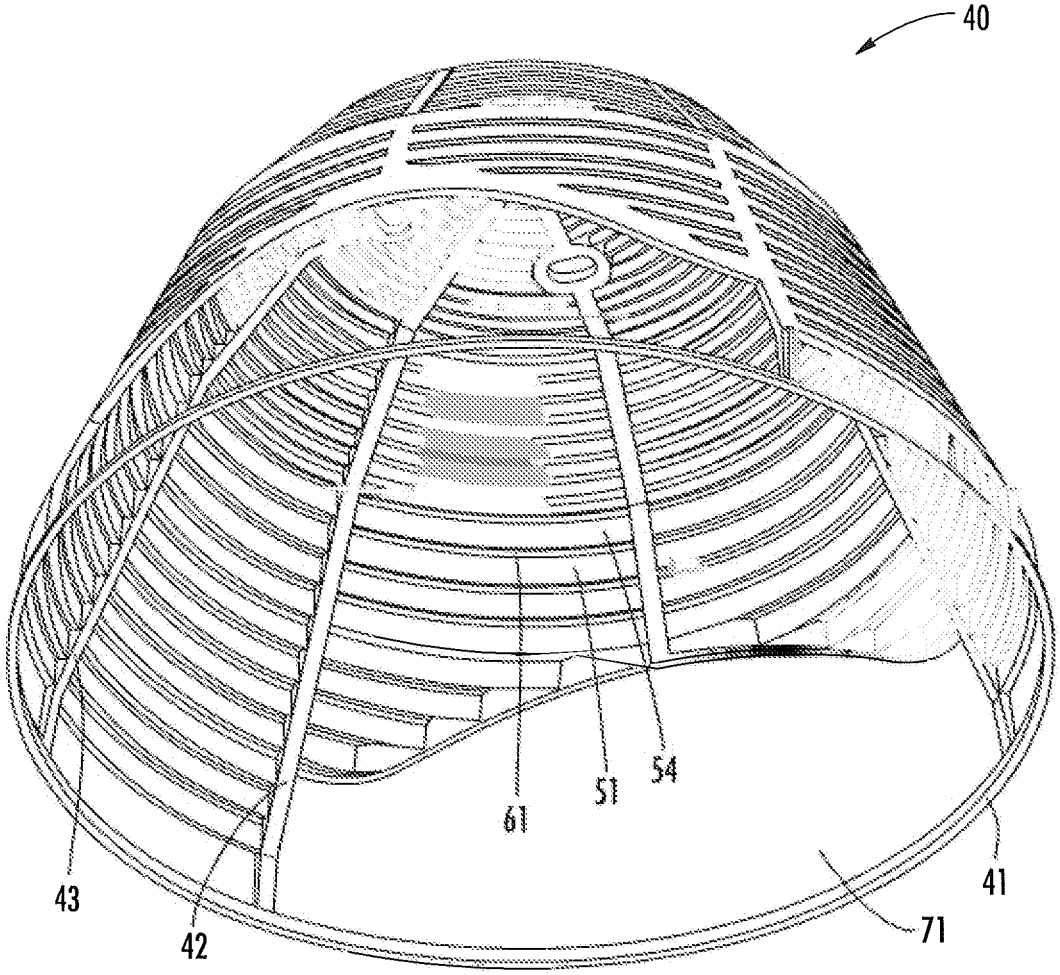
FIG. 2 is a perspective view of a skylight sunlight pivot in accordance with certain aspects of the present invention, from a lower, West position.

FIGS. 1 and 2 illustrate a particular embodiment of the pivot 40. As depicted in FIGS. 1 and 2, the pivot 40 includes a periphery 41. Also included is a first aperture 71, and a first strut 42 and a second strut 43. Residing between the first strut 42 and the second strut 43, and carried by them, are a first prism 51 and a second prism 54. Likewise, the first prism 51 and the second prism 54 define between them a first void 61. The first strut 42 and the second strut 43 may extend from about the periphery 41 upwardly and inwardly toward the apex 48.

Figure 3:
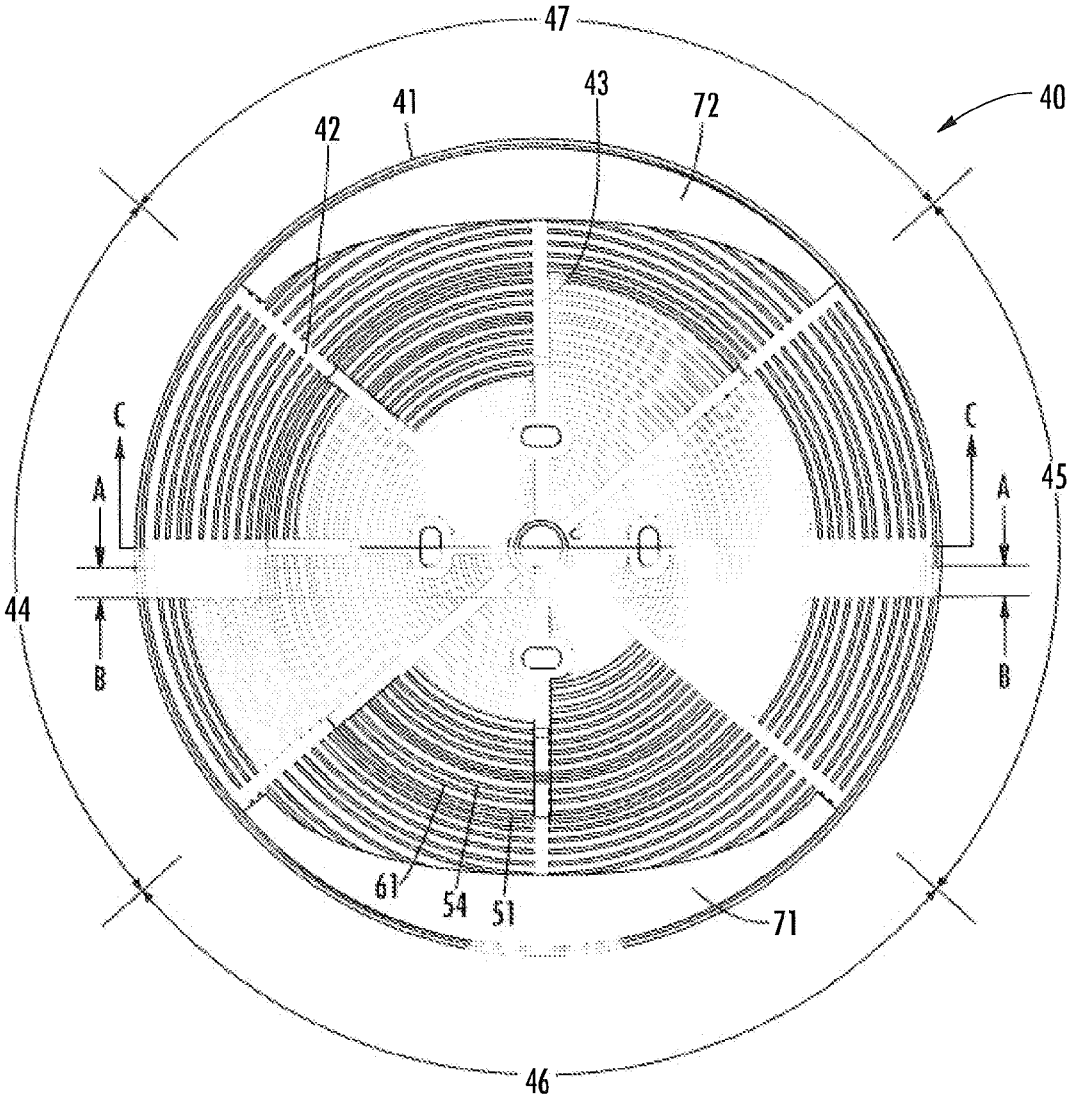
FIG. 3 is a plan view of a skylight sunlight pivot in accordance with certain aspects of the present invention.

FIG. 3 is a plan view of an embodiment of a pivot 40. A first prism 51 resides adjacent to a second prism 54, and the first prism 51 and the second prism 54 define between them a first void 61. A first aperture 71 and a second aperture 72 are included. Further, a periphery 41, a first strut 42, and a second strut 43 are provided. The pivot 41 may be understood to include an equatorial side 44, an opposite polar side 45, with an East side 46 and a West side 47. It is the East side 46 that may carry a first aperture 71, and the West side 47 that may include a second aperture 72. The East side aperture 71 and the West side aperture 72 may thereby increase receipt into skylight 10 of early morning and late afternoon low-incidence-angle sunlight, respectively.

Figure 4:
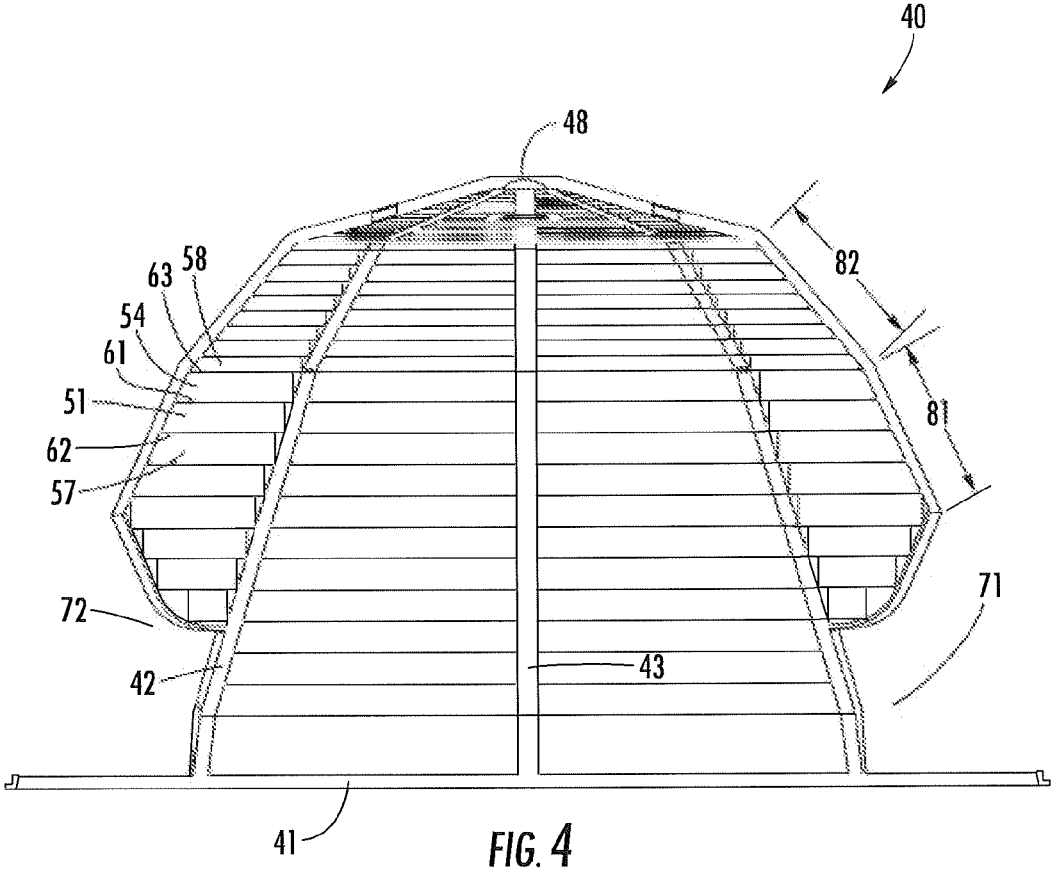
FIG. 4 is cross-section view of a skylight sunlight pivot in accordance with certain aspect of the present invention, taken at C:C in FIG. 3.
Figure 5:
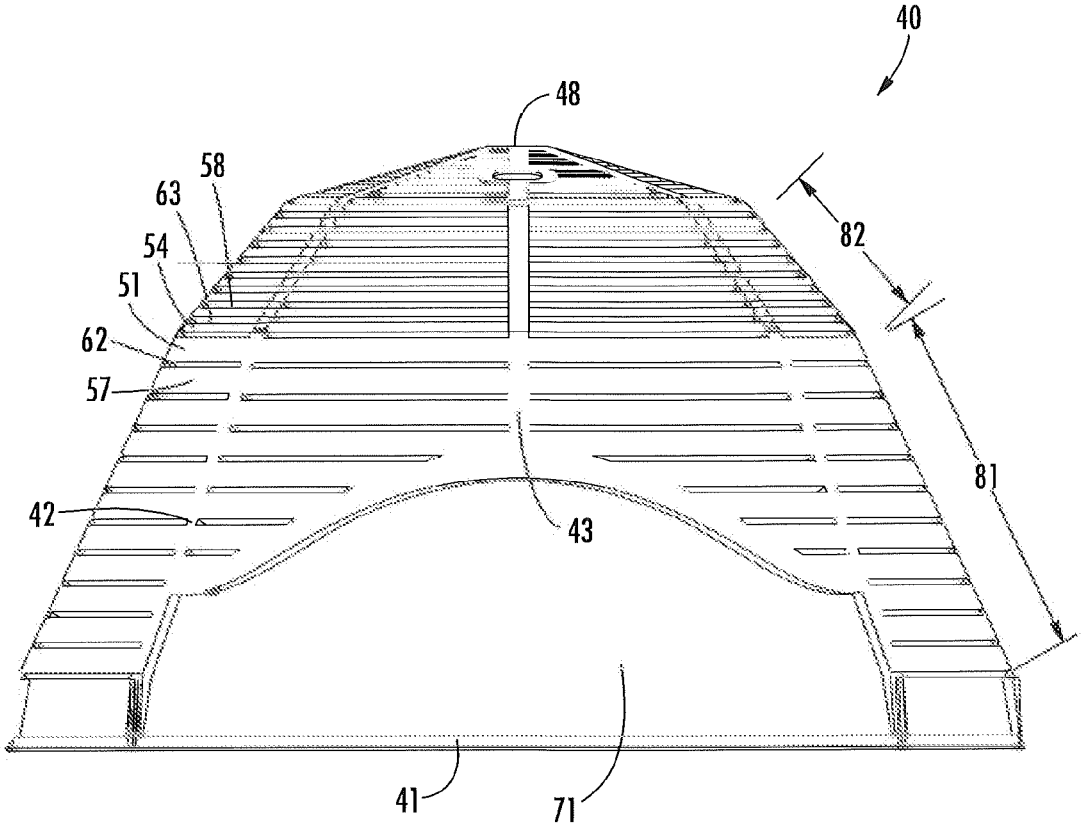
FIG. 5 is an East elevation view of a skylight sunlight pivot in accordance with certain aspects of the present invention.

FIGS. 4 and 5 are an embodiment of the pivot 40. That embodiment includes a periphery 41, a first strut 42, and a second strut 43, both of which extend upwardly and inwardly toward the apex 48. Also provided are a third prism 57 and a fourth prism 58. The first prism 52 and the second prism 54 define between them a first void 61. Similarly, the first prism 51 and the third prism 57 define between them a second void 62. Still further, the second prism 54 and the fourth prism 58 define between them a third void 63. As an optional feature of such an embodiment, the first prism 51 and the third prism 57 reside in a single first conical frustum, 81. Likewise, the second prism 54 and the fourth prism 58 reside in a single second conical frustum, 82. As shown in the embodiment depicted in FIGS. 4 and 5, the first conical frustum 81 is non-parallel to the second conical frustum 82. The first conical frustum 81 and the second conical frustum 82 are non-proportional, as illustrated in FIGS. 4 and 5. FIGS. 4 and 5 also include a first aperture 71 and, oppositely, a second aperture 72.

Figure 6:
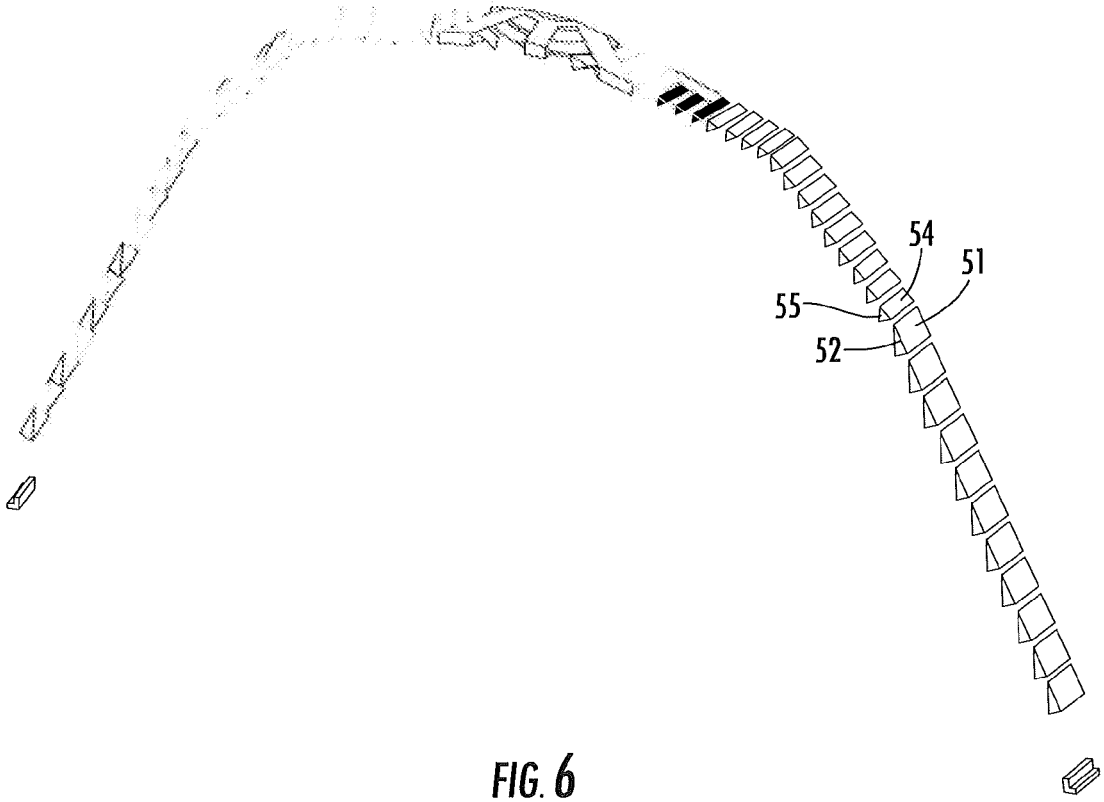
FIG. 6 is a sectional view of a detail of a skylight sunlight pivot in accordance with certain aspects of the present invention, taken between A:A and B:B in FIG. 3.

The embodiment of FIG. 6 includes a first prism 51 with a first cross-section 52. Likewise, a second prism 54 is provided, that has a second cross-section 55. As depicted in FIG. 6, first cross-section 52 and second cross-section 55 are different. In particular, with the embodiment shown in FIG. 6, first cross-section 52 is configured to redirect light incident upon the exterior of the pivot 41 to increase the amount of light passing through the periphery 41 into the light channel 30 than would occur in the absence of first prism 51. Conversely, the second cross-section 55 is configured to redirect light incident upon the exterior of the pivot 41 so as to decrease the amount of light passing through the periphery 41 into the light channel 30, than would otherwise occur in the absence of second prism 54.

Figure 7:
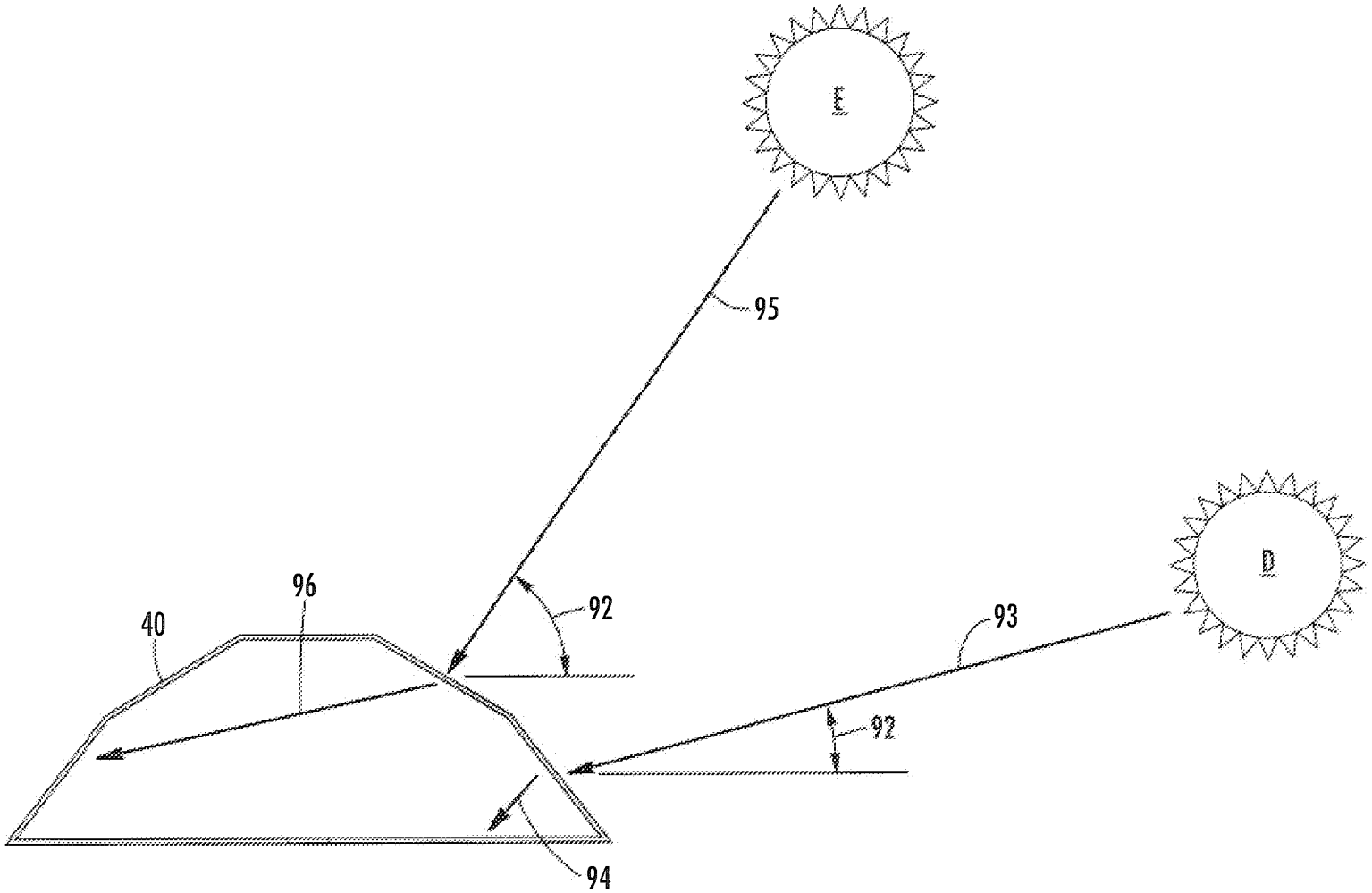
FIG. 7 is an operational illustration of a skylight sunlight pivot in accordance with certain aspects of the present invention.

FIG. 7 illustrates the operation of pivot 40. Morning or evening sunlight from the Sun at position D casts a first incident sunbeam 93 toward the pivot 40 at a relatively low first incident angle 91. Mid-day sunlight from the Sun at position E casts a second incident sunbeam 95 toward the pivot 40 at a relatively high second incident angle. By operation of prisms, for example a first prism 51 and, optionally, a third prism 57, first incident sunbeam 93 is redirected toward the periphery 41 of pivot 40, so as to increase the amount of light entering light channel 30 than would enter in the absence of pivot 40. A second incident sunbeam 95, from a mid-day Sun at position E, though, is redirected by, for example, a second prism 54 and, optionally, a fourth prism 58, so as to decrease the amount of sunlight than would pass through periphery 41 in the absence of the pivot 40.

Figure 8:
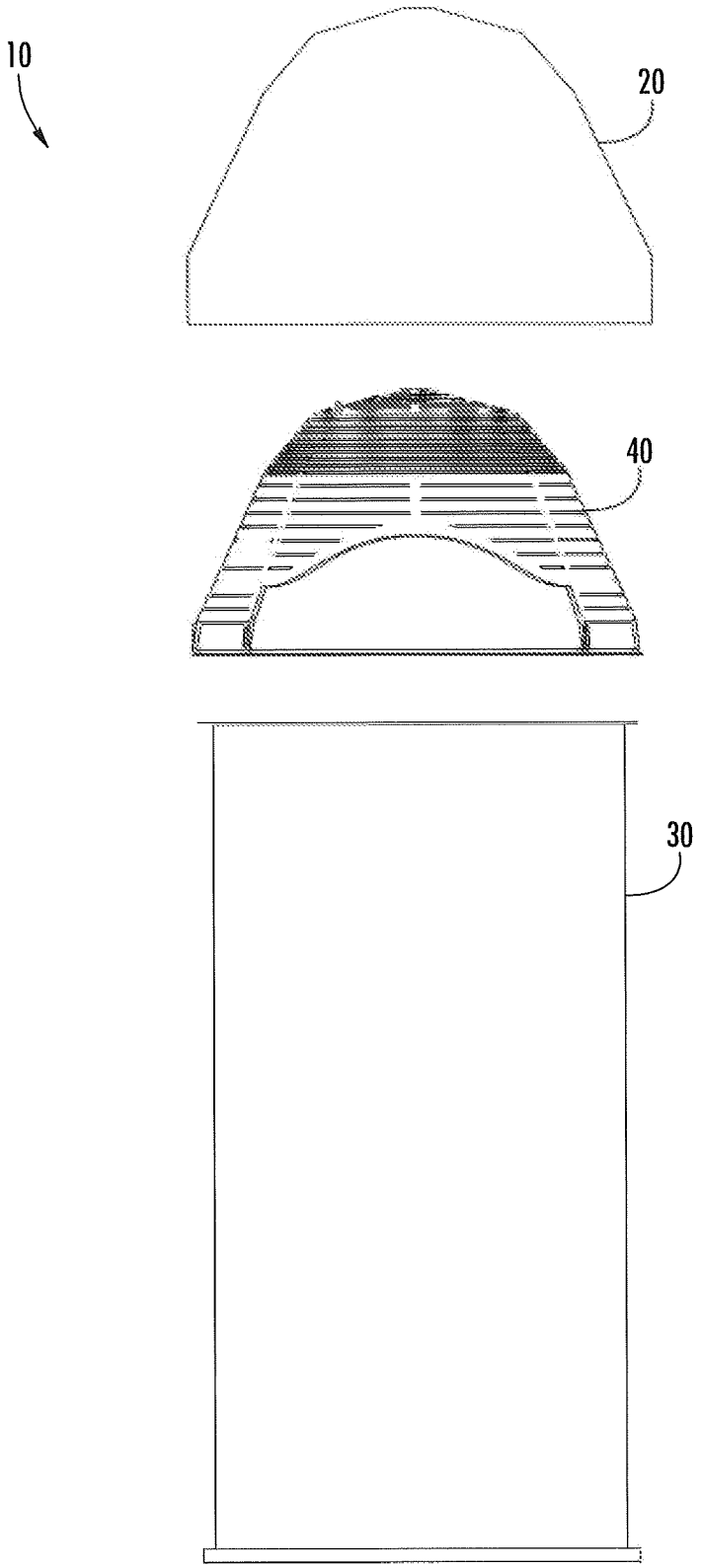
FIG. 8 is an operational illustration of a skylight sunlight pivot in accordance with certain aspects of the present invention.

FIG. 8 illustrates the relative positioning of cover 20, pivot 40, and light channel 30 of the skylight with sunlight pivot of the present invention, pivot 40 configured for receipt within cover 20 upon installation.

It should be appreciated that, in the above description of embodiments, various features are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that any claim requires more features that are expressly recited in that claim. Moreover, any components, features, or steps illustrated and/or described in a particular embodiment herein can be applied to or used with any other embodiment or embodiments. Thus, it is intended that the scope of the inventions herein disclosed should not be limited by the particular embodiments described above, but should be determined only by a true reading of the claims that follow.

The invention claimed is:

1. A skylight, comprising:

An external cover;

A light channel depending downwardly beneath said external cover;

A sunlight pivot, said sunlight pivot disposed beneath said external cover and above said light channel, said sunlight pivot including:

A periphery;

A plurality of struts, said plurality of struts extending from about said periphery, upwardly, and inwardly;

First and second prisms, said first and second prisms defining a first void therebetween and carried by at least two of said plurality of struts; and Said first prism defining a first cross-section and said second prism defining a second cross-section, said first cross-section different from said second cross-section.

2. The skylight of claim 1, in which said first prism extends in a first arc.

3. The skylight of claim 2, in which said second prism extends in a second arc, said second arc shorter than said first arc.

4. The skylight of claim 1, wherein said first prism terminates at an aperture that is devoid of refraction.

5. The skylight of claim 1, wherein said first prism is parallel to said periphery.

6. The skylight of claim 1, in which said periphery is curvilinear.

7. The skylight of claim 1, further including a third prism, said third prism residing adjacent to said first prism and defining a second void therebetween.

8. The skylight of claim 1, further including a fourth prism, said fourth prism residing adjacent to said second prism and defining a third void therebetween.

9. The skylight of claim 7, in which said first and third prisms reside in a single first conical frustum.

10. The skylight of claim 8, in which said second and fourth prisms reside in a single second conical frustum.

11. The skylight of claim 10, in which said first conical frustum is nonparallel to said second conical frustum.

12. A skylight, comprising:

An external cover;

A light channel below said external cover;

A sunlight pivot, said sunlight pivot disposed between said external cover and said light channel, said sunlight pivot including:

A periphery;

A plurality of struts, said plurality of struts extending upwardly and inwardly from proximate to said periphery;

First and second prisms, said first and second prisms defining a void therebetween and connected to at least two of said plurality of struts; and Said first prism defining a first cross-section configured to redirect light incident upon the exterior of the pivot to increase the amount of light passing through the periphery; and Said second prism defining a second cross-section configured to redirect light incident upon the exterior of the pivot to decrease the amount of light passing through the periphery.

13. The skylight of claim 12, in which said first prism is parallel to said periphery.

14. The skylight of claim 12, in which said first and second prisms are parallel.

15. The skylight of claim 12, in which said first and second prisms are curvilinear.

16. The skylight of claim 12, wherein said first cross-section and said second cross-section are each constant along their respective lengths.

17. The skylight of claim 12, in which said first and second prisms each are triangular in cross-section, the hypotenuses of said cross-sections facing outwardly from said pivot.

18. A skylight, comprising:

An external cover;

A light channel residing below said external cover;

A sunlight pivot, said sunlight pivot disposed between said external cover and said light channel, said sunlight pivot including:

A periphery and apex, said periphery residing below said apex;

A plurality of struts, each of said plurality of struts extending proximate from said apex toward said periphery;

A plurality of first prisms, each such first prism having the same first cross-section configured to refract light incident upon the exterior of the pivot to increase the amount of light passing into the skylight;

defining a void between any two of each such first prisms;

A plurality of second prisms, each such second prism having the same second cross-section configured to refract light incident upon the exterior of the pivot to decrease the amount of light passing into the skylight;

defining a void between any two of each such second prisms; and

Said plurality of first prisms and said plurality of second prisms carried by at least two of said plurality of struts.

19. The skylight of claim 18, wherein the plurality of first prisms resides in a first conical frustum and the plurality of second prisms resides in a second conical frustum, the first and second conical frustums being nonproportional.

20. The skylight of claim 18, wherein the first prisms are parallel to the second prisms.

* * * * *